US006045638A

United States Patent [19]

Lundstrom

[11] Patent Number: 6,045,638

[45] Date of Patent: Apr. 4, 2000

[54] MONOPROPELLANT AND PROPELLANT COMPOSITIONS INCLUDING MONO AND POLYAMINOGUANIDINE DINITRATE

[75] Inventor: Norman H. Lundstrom, Manassas, Va.

[73] Assignee: Atlantic Research Corporation, Gainesville, Va.

[21] Appl. No.: 09/168,568

[22] Filed: Oct. 9, 1998

[51] Int. Cl.[7] ..... C06B 47/08; C06B 31/32

[52] U.S. Cl. ..... 149/36; 149/47; 149/62

[58] Field of Search ..... 149/46, 61, 62, 149/76, 36, 47, 78

[56] References Cited

U.S. PATENT DOCUMENTS

| | | | |
|---|---|---|---|
| 1,423,264 | 7/1922 | Scheele . | |
| 2,929,698 | 3/1960 | Audrieth et al. | 52/5 |
| 4,948,439 | 8/1990 | Poole et al. | 149/46 |
| 5,386,775 | 2/1995 | Poole et al. | 102/289 |
| 5,518,054 | 5/1996 | Mitson et al. | 149/35 |
| 5,531,941 | 7/1996 | Poole | 264/3.4 |
| 5,608,183 | 3/1997 | Barnes et al. | 149/45 |
| 5,670,740 | 9/1997 | Barnes et al. | 149/62 |
| 5,684,269 | 11/1997 | Barnes et al. | 149/45 |
| 5,756,929 | 5/1998 | Lundstrom et al. | 149/22 |
| 5,847,315 | 12/1998 | Katzakian, Jr. et al. | 149/19.91 |
| 5,854,442 | 12/1998 | Scheffee et al. | 149/18 |
| 5,866,842 | 2/1999 | Wilson et al. | 149/19.6 |

OTHER PUBLICATIONS

I. Mutikaninen, M. Koskinen and H. Elo, "A Crystallographic Study on Aminoguanidine Dinitrate", Oct. 1994; pp. 739–741.

Lieber & Smith, "Chemistry of Aminoguanidine", Chemical Reviews, 26, 214 (1939).

*Primary Examiner*—Charles T. Jordan
*Assistant Examiner*—Aileen J. Baker
*Attorney, Agent, or Firm*—Nixon & Vanderhye P.C.

[57] ABSTRACT

A pyrotechnic gas generant composition including a high oxygen balance fuel that is the resulting reaction product of an aminoguanidine or polyaminoguanidine salt and nitric acid, namely, aminoguanidine dinitrate, diaminoguanidine dinitrate, and triaminoguanidine dinitrate. Specifically, aminoguanidine dinitrate, diaminoguanidine dinitrate, and triaminoguanidine dinitrate can be used as monopropellants or in combination with oxidizers and additives as a solid bipropellant composition. In each instance, the high oxygen balance fuel(s) of the present invention provide(s) both high gas output and low production of solid combustion products. Specifically, the high oxygen balance fuel(s) may be incorporated into gas generators, gun propellants, inflation and expulsion devices, flotation devices, pyrotechnics, fire suppression devices and smokeless, reduced smoke and metallized rocket propellants.

16 Claims, 2 Drawing Sheets

MONOPROPELLANT AND PROPELLANT COMPOSITIONS INCLUDING MONO AND POLYAMINOGUANIDINE DINITRATE

BACKGROUND OF THE INVENTION

1. Field of the Invention

The present invention relates to ingredients for use in propellant and gas generant compositions, and more specifically to fuels containing a high oxygen balance. The fuels are useful in smokeless, reduced smoke and metallized rocket propellants, gun propellants, and gas generants for engine starter cartridges, cartridge actuated devices, pressurization of liquid rocket propellant tanks, aircraft ejection seats, piston operated mechanical devices, air bag occupant restraint systems for automobiles, inflation and expulsion devices, flotation devices, and fire suppression devices.

2. Background Art

There is high demand for propellant and gas generant compositions that on combustion yield acceptable burning rates and provide, at relatively low flame temperatures, a high volume of substantially non-toxic gas and a low volume of solid particulate matter that can produce smoke. It is important that resulting solid by-products from the combustion of solid propellant compositions be minimal, and the gaseous combustion products be substantially non-toxic, and non-corrosive. Various compositions of propellants and gas generants have been utilized in the past in an attempt to reach the above desirable characteristics.

Prior art low vulnerability Class 1.3, minimum smoke and reduced smoke propellant compositions have been based on ammonium nitrate, but these compositions exhibit low burning rates and require the use of phase stabilizers in the oxidizer which results in formation of solid particulates in the exhaust.

Propellant compositions have also been developed to include the addition of modifiers to lower flame temperatures and increase gas production. Further ingredients may be added such as binders, ignition aids, slag formers, scavengers, and catalysts to improve various features of the underlying propellant. The modifiers and additional ingredients often times, however, improve one aspect of the propellant composition while also contributing to the production of undesirable by-products, and may increase the corrosiveness thereof. This is particularly disadvantageous for propulsion or mechanical device which require a high pressure gas in order to function properly, examples of which include guns, rocket motors, liquid propellant fuel tanks, jet engines, inflation devices, etc.

U.S. Pat. No. 5,386,775 discloses an azide-free gas generant composition for inflating an automobile or aircraft occupant safety restraint bag that allegedly reduces the toxicity of the gases produced by the gas generants. Specifically, a relatively low energy nitrogen containing fuel is combined with a burn rate accelator, such as an alkali metal salt. The fuel may be guanidine mononitrate, oxamide, ammonium oxalate, aminoguanidine bicarbonate, glycine nitrate, hydrazodicarbonamide or azodicarbonamide.

U.S. Pat. No. 5,608,183 discloses a gas generant composition containing amine nitrates and basic copper nitrate and/or cobalt triamine trinitrate. This gas generant composition was produced as an alternative to non-azide gas generant formulations.

U.S. Pat. No. 2,929,698 discloses an explosive composition produced from a diaminoguanidine mononitrate, monoperchlorate, or monopicrate salt of an acidic agent such as nitric acid, perchloric acid, or picric acid. The present invention pertains to propellant or gas generant compositions (not explosives) containing high oxygen balance fuels based on monoaminoguanidine, diaminoguanidine, and triaminoguanidine dinitrate salts of nitric acid. The mononitrate salts disclosed in the '698 patent do not exhibit a high oxygen balance exhibited by the present invention. Without the high oxygen balance achieved with the fuels of the present invention, a greater concentration of an oxidizer, such as phase-stabilized ammonium nitrate (PSAN), ammonium perchlorate (AP), or potassium perchlorate (KP) would be necessary to maintain an acceptable oxygen to fuel ratio. This would result in lower performance and a significantly greater concentration of corrosive gas or smoke particulates in the exhaust.

One major gas generating composition having desirable characteristics for use in inflation systems contains strontium nitrate and 5-aminotetrazole (SrN/5ATZ) as major constituents. This formulation is relatively non-toxic when compared with sodium azide systems, has good ballistic properties, and retains the majority of solid combustion products as a slag or clinker in the combustion or filtration areas of the inflator unit. These formulations also exhibit acceptable flame temperatures of 2250° K. to 2750° K., depending upon the stoichiometry of the formulation and the oxygen-to-fuel (O/F) ratio. Moreover, the strontium nitrate and 5-aminotetrazole formulations are relatively non-hygroscopic and the ingredients do not exhibit crystalline phase changes over the required operating temperature range.

Such a formulation, however, suffers with regard to gas output, especially, in the volume-limited systems of a driver's side air bag. This is because a high concentration of strontium nitrate is required to maintain a neutral O/F balance. Because inflator designs for use with automotive safety restraint systems are becoming smaller and thus, more volume-limited, propellants are required to provide greater gas output and still retain the desirable attributes of the strontium nitrate/5-aminotetrazole systems. In addition, the SrN/5ATZ compositions are not practical for use in gun systems, rocket systems, jet engine starter cartridges because of the low performance and high concentration of solid decomposition products formed during combustion.

Approaches have been taken to obtain the attractive features of the above-noted propellants, while overcoming the low gas and high solids output thereof. This has resulted in the development of propellants based on mixtures of potassium perchlorate and oxygenated fuels such as guanidine mononitrate and aminoguanidine mononitrate. These propellants are also relatively non-hygroscopic, provide excellent gas output, high burning rates, and only about two thirds of the solid combustion products of the above-noted strontium nitrate and 5-aminotetrazole based propellants. Unfortunately, for use in rocket and gun systems, these formulations still suffer from excessive solid combustion products. In air bag systems, the solid combustion products do not form clinkers or slags that deposit in the combustion or filtration area, but instead form very fine particulates in the gas stream that result in a smokey and dirty exhaust.

Smokey or dirty exhaust combustion products are not militarily or commercially desirable. This is particularly true for military weapons systems where detection by an adversary of the launch position of a missile is unacceptable. It is also true for automobile air bag systems because the production of such product may cause undue anxiety for drivers and passengers involved in an automobile accident in which air bags are deployed. As a result, there is a need for a propellant material or gas generant for use in a variety of applications that exhibits high gas output and performance upon combustion, but does not produce unwanted by-products upon combustion.

SUMMARY OF THE INVENTION

The object of the present invention is to improve upon and to overcome the deficiencies of the prior art and to provide a rocket propellant, gun propellant, or pyrotechnic gas generant composition that upon combustion produces a high gas output and acceptable bum rate with limited non-gaseous combustion products. The present invention provides a high performance source of gas for use in mechanical devices, jet engine starter cartridges, rocket and gun systems, and automotive safety systems.

Another object of the present invention is to provide a solid propellant or pyrotechnic gas generant composition including a high oxygen balance fuel based on aminoguanidine dinitrate, diaminoguanidine dinitrate, or triaminoguanidine dinitrate that produces the desirable high gas output at a low combustion temperature and reduced non-gaseous combustion products.

Still another object of the present invention is to provide a high oxygen balance fuel which can serve as a solid monopropellant.

Yet another object of the present invention is to provide a solid propellant or gas generating composition capable of producing a substantially high gas output upon combustion for use as a rocket or gun propellant or an automobile air bag propellant. Additionally, the composition of the present invention may also be employed to inflate such items as an inflatable raft or passenger escape chute of an airplane, as well as for pyrotechnics, ignition mixtures, and fire suppression devices. From a practical standpoint, the composition of the present invention also may include additives heretofore used with other gas generant compositions, such as oxidizers, gas conversion catalysts, ballistic modifiers, slag formers, ignition aids, energetic plasticizers and binders, energetic and non-energetic binders, and compounding aids.

The foregoing objects are generally achieved by a solid propellant or pyrotechnic gas generant composition including a high oxygen balance compound that is the resulting white/clear colored reaction product of a mono or polyaminoguanidine salt with nitric acid, an example of which is aminoguanidine dinitrate formed by the reaction of aminoguanidine nitrate and nitric acid. Specifically, the reaction product is a whitish/clear material that can be used alone, with no oxidizers or other additives, or combusted in combination with oxidizers and/or other additives. In each instance, the gas generant composition provides both high gas output and low production of solid decomposition products when combusted. Other examples of the present invention include the polyaminoguanidine dinitrate salts, examples of which include diaminoguanidine diintrate (DAGDN) and triaminoguanidine dinitrate (TAGDN).

As described above, an example of the present invention is the product aminoguanidine dinitrate (AGDN). In addition, the high oxygen balance fuel of the pyrotechnic gas generant composition of the present invention is also directed to the use of the whitish/clear colored reaction product(s) of an aminoguanidine and/or polyaminoguanidine salt with nitric acid.

The propellant composition(s) of the present invention is generally prepared by the methods heretofore employed for prior art compositions and generally, but not exclusively, involve dry or wet blending with or without binders followed by casting and curing or compaction of the comminuted ingredients selected for combination. In view of the advantageous characteristics of the gas generant composition of the present invention, namely, high gas output, low solid combustion products production and acceptable burn rate, the high oxygen balance fuels of the present invention have applications in rocket propellants, gun propellants, pyrotechnics, ignition mixtures, automobile air bag systems, inflatable rafts or passenger escape chutes, and fire suppression devices.

For purposes of the present invention, the terms propellant(s) and gas generant(s) are used interchangeably. Also, for the purposes of this invention, the reactions shown are with anhydrous components. The use of non-anhydrous components, however, is also contemplated.

DETAILED DESCRIPTION OF THE PREFERRED EMBODIMENTS

Figure 1:
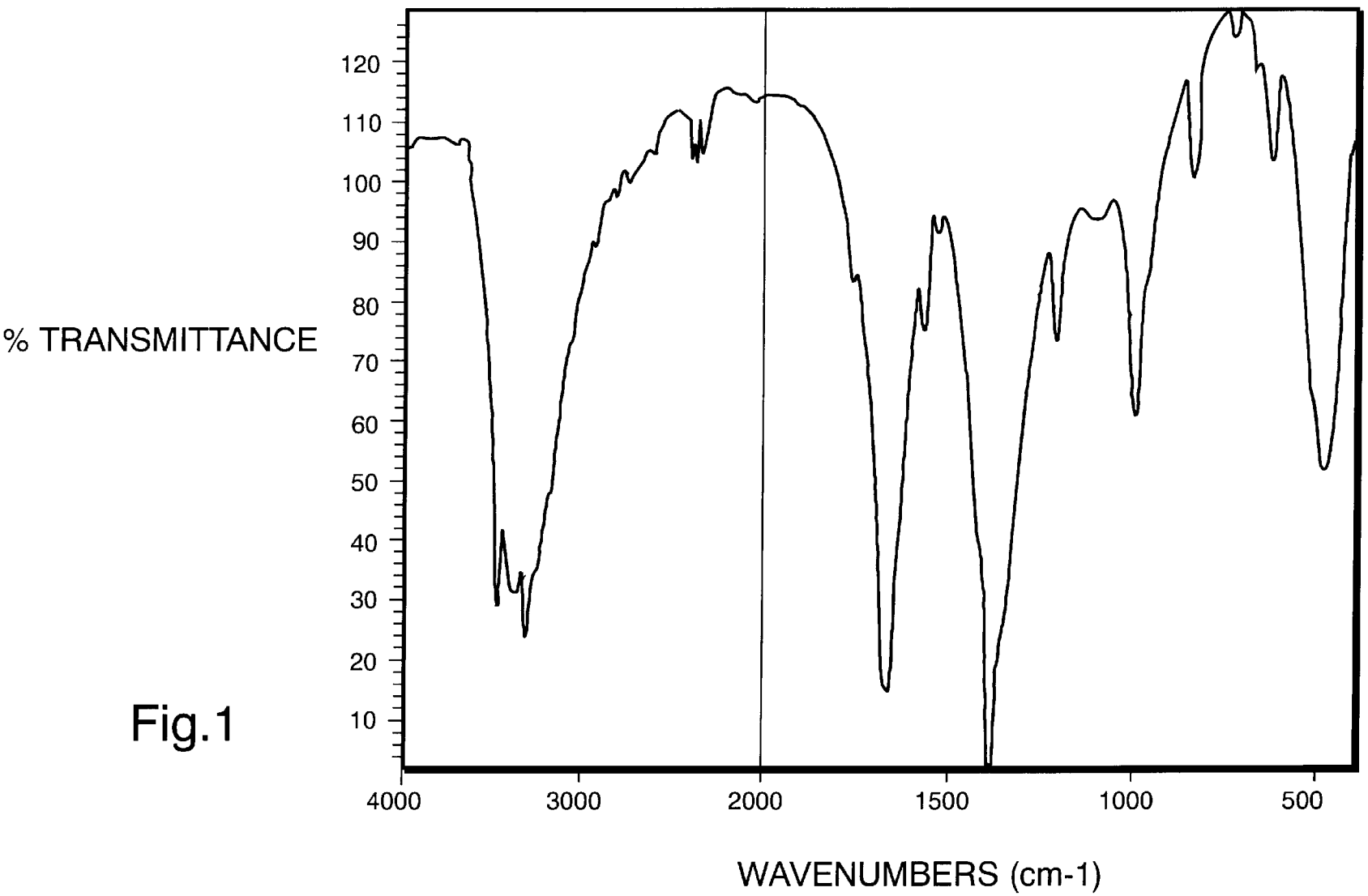
FIG. 1 is an infrared absorption spectra of the reaction product, aminoguanidine dinitrate, of the present invention.

The invention provides for a high oxygen balance fuel for use in a solid propellant, which when combusted provides high gas output and minimal solid combustion products and which is useful for various purposes. As one can see, the compositions based on the high oxygen balance fuel(s) disclosed in the present invention is particularly useful as a gun propellant, rocket propellant, pyrotechnic gas generant, ignition mixture, etc. In addition, the high oxygen balance fuel(s) of the present invention has the desirable features of a mono-propellant. As a result, the gas generant composition of the present invention can be a single ingredient solid monopropellant; a burning rate enhancing additive; and an ingredient in all pyro driver side as well as conventional and oxygenated hybrid inflation devices for automotive air bag safety systems.

Additional objects and advantages of the present invention will become readily apparent to those skilled in the art from the following detailed description wherein the preferred embodiments of the invention are shown and described simply by way of illustration of the best mode contemplated for carrying out the invention. As will be realized, the invention is capable of other and different embodiments and its several details are capable of modifications of various obvious respects, all without departing from the invention. Accordingly, the figures and description are to be regarded as illustrative in nature and not as restrictive.

More specifically, the solid propellant compositions of the present invention include a high oxygen balance fuel prepared from the reaction of nitric acid and an aminoguanidine or polyaminoguanidine salt to form the representative dinitrate salt, an example of which is aminoguanidine dinitrate (AGDN), $CH_8N_6O_6$ and described in Mutikainen et al., *Die Pharmazie* (October, 1994).

This invention is not limited, however, to only AGDN, diaminoguanidine dinitrate (DAGDN), and triaminoguanidine dinitrate (TAGDN), but is also directed to the solid whitish/clear colored polynitrate product from the reaction of nitric acid and an aminoguanidine or polyaminoguanidine salt, as provided in detail below.

The above-noted work by Mutikainen et al. was in conjunction with an investigation of materials for their pharmacological properties, which is entirely different from the present invention.

Aminoguanidine has the property, similar to hydrazine, of functioning as a diacid base which when reacted with nitric acid under the proper conditions results in the formation of a dinitrated salt of aminoguanidine rather than the conventional mononitrated form commonly used in gas generants of the prior art. Diaminoguanidine and triaminoguanidine, in addition to aminoguanidine, are also able to form dinitrates. Therefore, in accordance with this invention, monoaminoguanidine dinitrate, diaminoguanidine dinitrate, and triaminoguanidine dinitrate either separately or in mixtures thereof are disclosed herein for use as mono-propellant or bi-propellant formulations for use as smokeless, reduced smoke, or metallized solid rocket propellants and gun propellants. These formulations also have utility for use in air bag occupant restraint systems for automobiles, inflation and expulsion devices, flotation devices, ignition materials, pyrotechnics, and fire suppression devices.

In addition, this invention includes any compound of aminoguanidine, diaminoguanidine, or triaminoguanidine or mixtures thereof with two or more nitrate groups or with a combination of two or more nitro and/or nitrate groups. Further, it will be understood that the teachings herein encompass anhydrous, as well as hydrated forms of the compounds.

Prior art solid minimum smoke propellants, such as those containing ammonium nitrate, produce very little solid combustion products, but have a number of other properties that make them less desirable. Ammonium nitrate, for instance, is hygroscopic. Moreover, in gas generant/propellant compositions, its use results in a low burn rate and a high pressure exponent at operating pressures of 1000–2000 psi. Consequently, a propellant composition containing ammonium nitrate as the principal oxidizer must be burned at very high pressures, e.g. 4000–6000 psi, and sealed to prevent moisture from contacting the composition. In addition, ammonium nitrate typically requires the use of phase stabilizers, such as potassium compounds, which generate solid combustion products.

The high oxygen balance fuel(s) of the present invention overcome(s) a number of the above-noted, less than desirable characteristics associated with ammonium nitrate propellant formulations. Specifically, compositions including the aminoguanidine and/or polyaminoguanidine dinitrate high oxygen balance fuels of the present invention exhibit a high gas output with no or little resulting solid combustion product or ash, while also providing acceptable burning rates for use in propellant and gas generant applications. As a result, the composition of the present invention does not have to be combusted at such a high pressure as the above-noted ammonium nitrate gas generant propellant compositions.

The propellant compositions containing aminoguanidine and/or polyaminoguanidine dinitrate of the present invention can function alone if desired as a monopropellant, as noted above, or may include an oxidizer. Preferably, the propellant composition includes 2–100% by weight of the high oxygen balance fuel of the present invention, and more preferably, 50–100% by weight. Other materials may be also be added to the composition for improving performance, processing, aiding ignition, enhancing ballistics, improving thermal aging and stability, improving hazardous properties, reducing particulates, binding, and scavenging undesirable gaseous combustion products.

A single oxidizer or multiple oxidizers with or without an energetic plasticizer or binder may be combined with the high oxygen balance fuel of the present invention to supply additional oxygen for achieving the desired oxygen to fuel balance (O/F) during combustion. Since the high oxygen balance fuels of the present invention including aminoguanidine and/or polyaminoguanidine dinitrate contain a larger amount of oxygen than prior fuels used in propellant and gas generating compositions, a smaller amount of oxidizer for providing a desirable O/F balance is necessary. Suitable metallic and non-metallic oxidizers are known in the art and generally comprise nitrites, nitrates, chlorites, chlorates, perchlorates, oxides, peroxides, persulfates, chromates and perchromates of non-metals, alkali metals, alkaline earth metals, transition metals and transition metal complexes and mixtures thereof. Preferred oxidizers include ammonium perchlorate, phase-stabilized ammonium nitrate, potassium perchlorate, strontium nitrate, potassium nitrate, sodium nitrate, barium nitrate, potassium chlorate, and mixtures thereof. The preferred oxidizers are generally employed in a concentration of about 0–50% by weight of the total gas propellant composition.

Metal fuels may be added to the propellant compositions containing the aminoguanidine and/or polyaminoguanidine dinitrate high oxygen balance fuels of the present invention. Suitable metallic fuels include aluminum, zirconium, magnesium, and other metal powders commonly used in solid propellants.

In addition to the above-noted additives, the high oxygen balance fuel of the present invention may also be combined with other fuels and/or energetic nitro and/or nitrato plasticizers and/or energetic and non-energetic binders to provide a gas generant/propellant composition. Suitable fuels for such combination with the fuel of the present invention include but are not limited to the families of azido, hydrazine. guanidine, tetrazole, triazole, triazine, polyamine, nitramine (linear and cyclic), and derivatives of these families of fuels, as well as mixtures thereof. Suitable energetic plasticizers include but are not limited to butanetriol trinitrate (BTTN), nitroglycerine (NG), triethyleneglycol dinitrate (TEGDN), trimethylolethane trinitrate (TMETN) and mixtures thereof. An example of an energetic binder includes glycidyl azide polymer (GAP).

Scavengers may be desirable to control the production of corrosive combustion products. For example, if a non-metal oxidizer is used, such as ammonium perchlorate, hydrogen chloride (HCl) can be produced as a resulting reaction product, which is clearly undesirable. To prevent the production of HCl, a scavenger such as sodium nitrate can be used to form sodium chloride instead. Scavengers for toxic gas may also be employed.

It may be desirable to add binders for improving the mechanical properties. Suitable binders include liquid cast/cure polyether and polyester, polyurethane, or polybutadiene binders. Suitable solid processing aids for pressed formulations include molybdenum disulfide, graphite, boron nitride, alkali metal, alkaline earth and transition metal stearates. Other binders include solid polyethylene glycols, polyacetals, polyvinyl acetates, polyvinyl alcohols, polycarbonates such as Q-PAC, fluoropolymers commercially available under the trade name TEFLON, and silicones. The compounding aids when used in pressed compositions are typically employed in concentrations of about 0.1 to 10% by weight of the total propellant composition. The binders are typically employed in concentrations of 2–30% by weight of the total propellant composition.

The combustion of the high oxygen balance fuel of the present invention may also be controlled by the addition of ballistic modifiers that include burning rate catalysts, which influence the temperature sensitivity, pressure exponent, and rate at which the propellant burns. Such ballistic modifiers were primarily developed for solid rocket propellants, but have also been found useful in gas generants for inflatable devices. Examples of ballistic modifiers useful with the composition of the present invention include oxides and halides of Group 4 to 12 of the Periodic Table of Elements (as developed by IUPAC and published by the CRC Press, 1989); sulfur and metal sulfides; transition metal salts containing copper, chromium, cobalt, nickel and mixtures thereof; and alkali metal and alkaline earth metal borohydrides. Guanidine borohydrides and triaminoguanidine borohydrides have also been used as ballistic modifiers. Organometallic ballistic modifiers include metallocenes, ferrocenes and metal acetyl acetonates. Other ballistic modifiers include salts of dicyanamide, nitroguanidine guanidine chromate, guanidine dichromate, guanidine trichromate, and guanidine perchromate. The ballistic modifiers are generally employed in concentrations varying from about 1–20% by weight of the total gas generant composition.

Another additive found to aid in the ease and temperature of ignition and resulting combustion of gas generant compositions is an ignition aid. Ignition aids include finely divided elemental sulfur, boron, boron-potassium nitrate ($BKNO_3$), carbon, magnesium, aluminum, and Group 4 transition metals, transition metal oxides, hydrides and sulfides, the hydrazine salt of 3-nitro-1,2,4-triazole-5-one and mixtures thereof. The ignition aids are normally employed in concentrations of 1–10% by weight of the total gas generant composition.

Filterable slag formation can be enhanced by the addition of a slag former. Such a slag former may not, however, be necessary in the present invention in view of the limited amount of solid combustion product produced. Suitable slag formers, if deemed necessary, include lime, borosilicates, vycor glasses, bentonite clay, silica, alumina, silicates, aluminates, transition metal oxides, alkaline earth compounds, lanthanide compounds, and mixtures thereof.

Stabilizers such as ethyl centralite, 2-nitrodiphenylamine (2-NDPA), and 4-nitrodiphenylamine (4-NDPA), etc. may also be incorporated into the high oxygen balance fuels of the present invention.

The manner and order in which the components of the propellant composition of the present invention are combined and compounded are not critical so long as an intimate, uniform mixture with good structural integrity is obtained, the compounding is carried out under conditions that are not unduly hazardous, and that do not cause decomposition of the components employed. For example, the materials may be processed into a cast-cure formulation with a BAKER-PERKINS sigma-blade mixer, wet blended in aqueous or nonaqueous liquids, or dry blended, with or without binders or processing aids, in a ball mill or "RED DEVIL" type paint shaker and then extruded, pelletized by compression molding, or formed into a castable or compression molded monolithic grain. The materials may also be ground separately or together with or without binders and/or other additives in a fluid energy mill, "SWECO" vibroenergy mill, or bantam micro-pulverizer, and then blended or further blended in a v-blender prior to compaction.

The various components described hereinabove for use with the novel monoaminoguanidine and/or polyaminoguanidine dintrate high oxygen balance fuels of the present invention have been used heretofore in other propellant and gas generant compositions. References involving gas generant compositions describing various additives include U.S. Pat. Nos. 5,035,757; 5,084,118; 5,139,588; 4,948,439; 4,909,549; and 4,370,181. As taught in this art and as will be apparent to those skilled in the art, it is possible to combine the functions of two or more additives into a single composition. Thus, alkaline earth metal salts of tetrazoles, bitetrazoles and triazoles not only function as gas generant components but can also be used as slag formers. It has also been found that strontium nitrate, for instance, acts not only as an oxidizer and a slag former, but also is effective as a ballistic modifier, ignition aid, densifier and processing aid.

The monoaminoguanidine and/or polyaminoguandine dinitrate high oxygen balance fuels of the present invention can utilize conventional gas generator mechanisms of the prior art. These are referred to in U.S. Pat. No. 4,369,079, incorporated herein by reference. Generally, the methods of the prior art involve the use of a hermetically sealed metallic cartridge containing a gas generant composition. Specifically, upon initiation of combustion by the firing of a squib, the sealing mechanism ruptures. This allows gas to flow out of the combustion chamber through several orifices. Of course, other gas generator mechanisms may equally be employed for use with the gas generant composition of the present invention.

Because of the burning rates exhibited by the high oxygen balance fuels of the present invention at moderate to low operating pressures, the invention may also be considered for use in the physical form of a monolithic grain.

The high oxygen balance fuels of the present invention may also serve the functions of a solid monopropellant. In addition, the high oxygen balance fuels of the present invention permit the use of much lower concentrations of oxidizer components and results in a much lower concentration of solid, smokey combustion products and greater gas output, which is particularly advantageous for volume limited systems. As a result, the high oxygen balance fuels of the present invention have applications in both minimum smoke and reduced smoke missile systems, and pyrotechnic gas generation systems.

Although the whitish/clear solid reaction product of aminoguanidine nitrate and nitric acid disclosed in the present invention is assumed to be aminoguanidine dinitrate (AGDN), this invention is not limited only to this specific high oxygen balance fuel. The present invention also pertains to diaminoguanidine dinitrate (DAGDN) and triaminoguanidine dinitrate (TAGDN). For simplicity, use of the term AGDN, DAGDN, and TAGDN refers both to anhydrous and any hydrous versions, unless specifically indicated otherwise.

In order to better understand the function of the high balance fuel of the present invention, examples of theoretical reactions of AGDN as an ingredient in a pyrotechnic gas generant are provided below wherein the formula for the AGDN is as (1) Neat AGDN as a solid monopropellant for use by itself in gas generators, in compressed gas hydbrid systems or ignition systems:

| | | | | | |
|---|---|---|---|---|---|
| $CH_8N_6O_6$ ----> | $4H_2O$ | + | $CO_2$ | + | $3\ N_2$ |
| 100.0% | 36.0% | | 22.00% | | 42.00% |
| | 2.00M | | 0.50M | | 1.50M |

Total Gas Output: 100.0 Wt. %
Total Gas Output (Moles): 4.000 Moles/100 grams
Total Solid Combustion Products: Zero Wt. %

(2) AGDN/Aminoguanidine Nitrate (AGN)/Lithium Nitrate:

| | | | | | | | | | | |
|---|---|---|---|---|---|---|---|---|---|---|
| $CH_8N_6O_6$ | + | $CH_7N_5O_3$ | + | $LiNO_3$ ----> | $\frac{1}{2}Li_2O$ | + | $7\frac{1}{2}H_2O$ | + | $2CO_2$ | + | $6N_2$ |
| 49.26% | | 33.74% | | 17.00% | 3.69% | | 33.26% | | 21.67% | | 41.38% |
| | | | | | 0.123M | | 1.848M | | 0.493M | | 1.478M |

Total Gas Output: 96.31 Wt. %
Total Gas Output (Moles): 3.819 Moles/100 grams
Total Solid Combustion Products: 3.69%

(3) AGDN/AGN/Sodium Nitrate:

| | | | | | | | | | | |
|---|---|---|---|---|---|---|---|---|---|---|
| $CH_8N_6O_6$ | + | $CH_7N_5O_3$ | + | $NaNO_3$ ----> | $\frac{1}{2}Na_2O$ | + | $7\frac{1}{2}H_2O$ | + | $2CO_2$ | + | $6N_2$ |
| 47.39% | | 32.46% | | 20.14% | 7.35% | | 31.99% | | 20.85% | | 39.81% |
| | | | | | 0.119M | | 1.777M | | 0.474M | | 1.422M |

Total Gas Output: 92.65 Wt % (O/F = 1.00)
Total Gas Output (Moles): 3.673 Moles/100 grams
Total Solid Combustion Products: 7.35 Wt. % (O/F = 1.00)

(4) AGDN/AGN/Guanidine Nitrate (GN)/Sodium Nitrate:

| | | | | | | | | | | | | | | | | |
|---|---|---|---|---|---|---|---|---|---|---|---|---|---|---|---|---|
| $2\ CH_8N_6O_6$ | + | $CH_7N_5O_3$ | + | $CH_6N_4O_3$ | + | $2NaNO_3$ --> | $Na_2O$ | + | $14\frac{1}{2}$ | + | $4CO_2$ | + | $11\frac{1}{2}N_2$ | + | $\frac{1}{4}O_2$ |
| 48.25% | | 16.53% | | 14.72% | | 20.50% | 7.48% | | $H_2O$ | | 21.23% | | 38.84% | | 0.97% |
| | | | | | | | 0.121M | | 31.48% | | 0.483M | | 1.387M | | 0.030M |
| | | | | | | | | | 1.749M | | | | | | |

Total Gas Output: 92.52 Wt %
Total Gas Output (Moles): 3.649 Moles/100 grams
Total Solid Combustion Products: 7.48 Wt. %

(5) AGDN/Guanidine Nitrate (GN)/Sodium Nitrate:

| | | | | | | | | | | | | | | | |
|---|---|---|---|---|---|---|---|---|---|---|---|---|---|---|---|
| $CH_8N_6O_6$ | + | $CH_6N_4O_3$ | + | $NaNO_3$ ---> | $\frac{1}{2}Na_2O$ | + | $7H_2O$ | + | $2CO_2$ | + | $5\frac{1}{2}N_2$ | + | $\frac{1}{4}O_2$ |
| 49.14% | | 29.98% | | 20.88% | 7.62% | | 30.96% | | 21.62% | | 37.84% | | 1.97% |
| | | | | | 0.246 | | 1.720M | | 0.491M | | 1.351M | | 0.062M |

Total Gas Output: 92.39 Wt %
Total Gas Output (Moles): 3.624 Moles/100 grams
Total Solid Combustion Products: 7.61 Wt. %

(6) AGDN/Nitroguanidine/Sodium Nitrate:

| | | | | | | | | | | | | | | | |
|---|---|---|---|---|---|---|---|---|---|---|---|---|---|---|---|
| $CH_8N_6O_6$ | + | $CH_4N_4O_2$ | + | $NaNO_3$ ---> | $\frac{1}{2}Na_2O$ | + | $6H_2O$ | + | $2CO_2$ | + | $5\frac{1}{2}N_2$ | + | $\frac{1}{4}O_2$ |
| 51.41% | | 26.74% | | 21.85% | 7.97% | | 27.76% | | 22.62% | | 39.59% | | 2.06% |
| | | | | | 0.129M | | 1.542M | | 0.514M | | 1.414M | | 0.064M |

Total Gas Output: 92.03 Wt %
Total Gas Output (Moles): 3.534 Moles/100 grams
Total Solid Combustion Products: 7.93 Wt. %

(7) AGDN/GN/Strontium Nitrate:

| | | | | | | | | | | | | | | | |
|---|---|---|---|---|---|---|---|---|---|---|---|---|---|---|---|
| $CH_8N_6O_6$ | + | $CH_6N_4O_3$ | + | $\frac{1}{2}Sr(NO_3)_2$ ---> | $\frac{1}{2}SrO$ | + | $7H_2O$ | + | $2CO_2$ | + | $5\frac{1}{2}N_2$ | + | $\frac{1}{4}O_2$ |
| 46.73% | | 28.50% | | 24.77% | 12.15% | | 29.44% | | 20.56% | | 35.98% | | 1.87% |
| | | | | | 0.117M | | 1.636M | | 0.467M | | 1.285M | | 0.058M |

Total Gas Output: 87.85 Wt %
Total Gas Output (Moles): 3.446 Moles/100 grams
Total Solid Combustion Products: 12.15 Wt. %

As provided by the above theoretical reactions of AGDN, a substantial gas output is possible by utilizing the fuel of the present invention. In most cases, the gas output is over 90 wt %. Even at the greater level of solid combustion products formed, the gas generant of the present invention utilizing AGDN produces less solid combustion products than prior gas generant compositions.

The specific process of obtaining the resulting high oxygen balance fuels of the present invention, an example of which is aminoguanidine dinitrate formed from the reaction of aminoguanidine nitrate and nitric acid, is provided below. Further, use of this resulting reaction product with various additives are also provided to demonstrate the advantageous features thereof. Consequently, aminoguanidine dinitrate as used in the examples provided below refers to the actual prismatic plates of Example 1.

EXAMPLE 1

The preparation of aminoguanidine dinitrate of the present invention was carried out using the following reaction, as described by Mutikainen, Koskinen, and Elo, *Die Pharmazie* (October 1994):

$$2HNO_3+CH_6N_4\cdot H_2CO_3 \rightarrow CH_6N_4\cdot 2HNO_3+CO_2+H_2O$$

Specifically, 2.2 moles nitric acid was reacted with 1.0 mole of aminoguanidine bicarbonate and heated at 60° C. for 40 minutes. The colorless solution was allowed to evaporate at room temperature, and yielded colorless prismatic plates.

A sample of the AGDN was used to determine the melting point. The sample was heated on an aluminum blank at approximately 40° F. per minute and gave a melting point of 225–230° F. (107–110° C.). The sample began micro bubbling at 275° F. (135° C.) and major bubbling at 440° F. with brownish colored bubble edges 450° F. (232° C.). Smoke appeared at 450° F. with major decomposition occurring at 480–490° F. (250–255° C.). The black residue resulting at approximately 528° F. (270° C.) was minimal compared to the original sample and pH was approximately 4.0.

When a sample of AGDN was placed in a watch glass and subjected to the impinging flame of a propane torch, melting occurred immediately resulting in a milky residue when the torch was removed. A pH of the residue was approximately 2.0 to 3.0.

Figure 2:
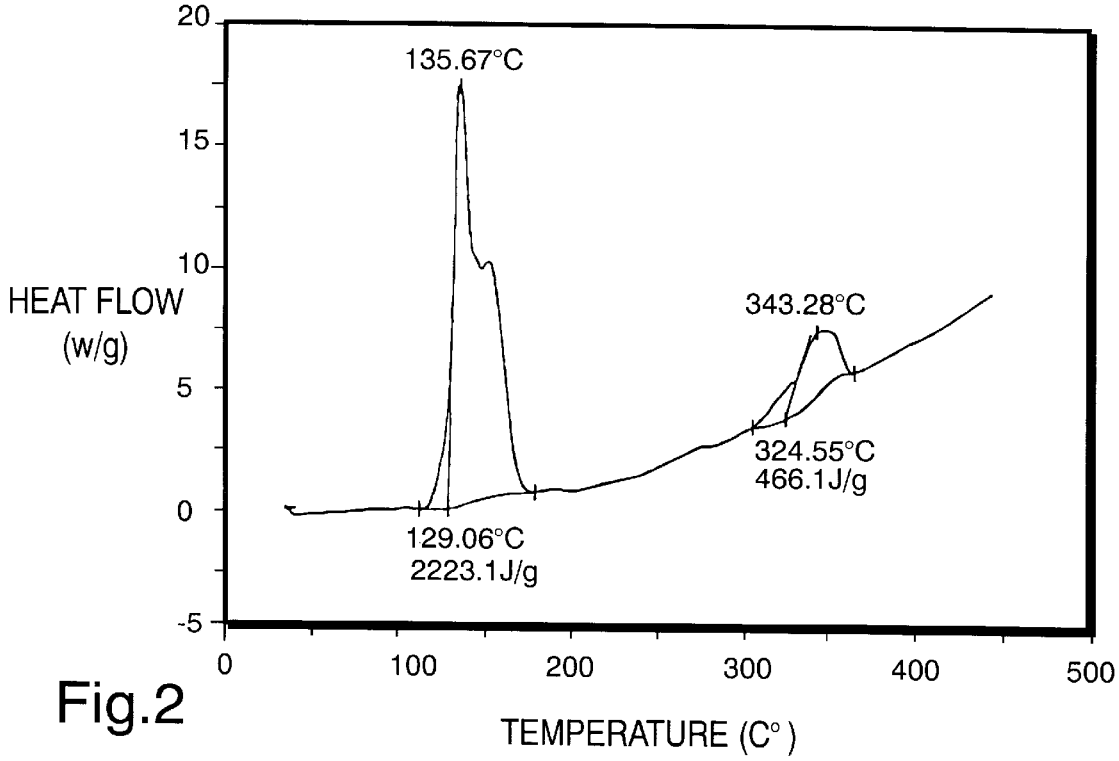
FIG. 2 is a differential scanning calorimetry of aminoguanidine dinitrate made in accordance with the present invention.
Figure 3:
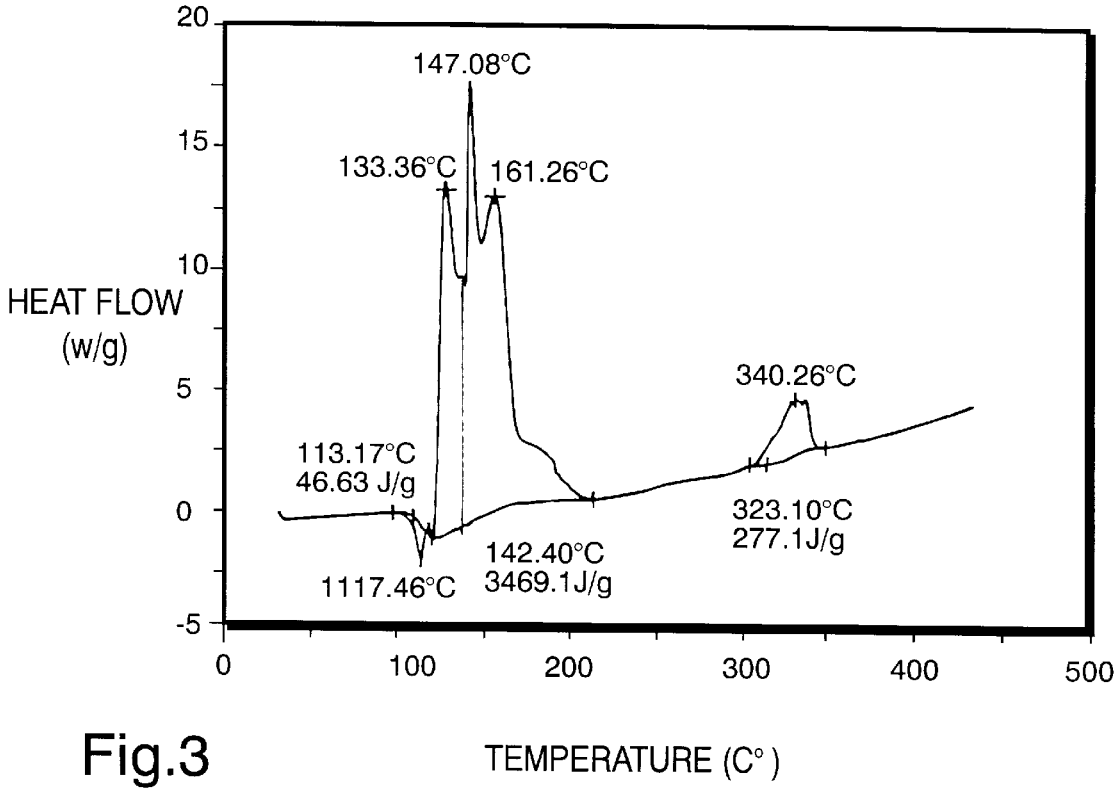
FIG. 3 is a further differential scanning calorimetry of aminoguanidine dinitrate made in accordance with the present invention.

FIG. 1 provides an infrared spectra for aminoguanidine dinitrate of the present invention. FIGS. 2 and 3 are differential scanning calorimetry graphs of the aminoguanidine dinitrate of the present invention.

Hazard data was also collected for the aminoguanidine dinitrate of the present invention, which is summarized below in Table 1.

TABLE 1

| HAZARD DATA FOR AMINOGUANIDNE DINITRATE | |
|---|---|
| IMPACT, $E_o$ | 10 NEG @ 1.0 KG @ 50 cm |
| Friction, AOL | 10 NEG @ 300 psi @ 90° |
| EDS | 10 NEG @ 6 Joules |

The data shown in Table 1 indicate AGDN to be reasonably acceptable with regard to sensitivity to impact, friction, and electrostatic discharge.

Thermochemical data was also collected by utilizing a computerized equilibrium thermochemistry program. Specifically, such data was collected for aminoguanidine dinitrate. The results of this data is provided below in Table 2. The data provides a thermochemical profile for the combustion of AGDN at 1000 psia, and the associated flame temperature and moles of gas formed at equilibrium conditions. The data indicates that the flame temperature and gas output from AGDN is conducive for use in gas generation systems.

TABLE 2

| | ATOMIC COMPOSITION OF INGREDIENTS, GM-ATOMS/GFU | | | | MASS | HT FORM | DENSITY |
|---|---|---|---|---|---|---|---|
| INGREDIENT | H | C | N | O | GRAMS | KCAL/GFW | CM/CM3 |
| AGDN | 8.000 | 1.000 | 6.000 | 6.000 | 100.000 | −144,000 | 1.7580 |

GRAM ATOM AMOUNTS FOR PROPELLANT MASS OF 100,000 GRAMS

| (N) | (C) | (N) | (O) |
|---|---|---|---|
| 3.997771 | .499721 | 2.998328 | 2.998328 |

PROPELLANT ENTHALPY = −71959.9 CAL/100 GM; PROPELLANT DENSITY = 1.758 G/CC - .06352 LBM/IN3

| | ISP LBF*S LBM | IVAC LBF*S LBM | PRES-SURE PSIA | TEMP. DEG K | ENTHALPY CAL 100 GM | ENTROPY CAL K*100 GM | HT. CAP CAL K* 100 GM | MOLS GAS MOLES 100 GM | VELOC FT SEC | AE/M FT2*SEC LBN | C° FT SEC | IVOL LBF*S IN3 |
|---|---|---|---|---|---|---|---|---|---|---|---|---|
| CHAMBER | | | 1000.0000 | 2462.6 | −71960. | 239.005 | 46.160 | 4.0255 | | | | |
| EQ. XNST | 227.9 | 245.7 | 14.700 | 1175.1 | −131650. | 239.005 | 39.470 | 3.0978 | 7332.4 | .0084187 | | 14.475 |
| F#2 THRT | 97.0 | 176.9 | 561.7072 | 2226.6 | −82770. | 239.005 | 45.406 | 4.0255 | 3120.4 | .0009878 | 4576.5 | |
| F#2 XHST | 224.9 | 242.2 | 14.7000 | 1117.6 | −130068. | 239.010 | 38.998 | 4.0255 | 7234.6 | .0081718 | | |

MOLES PER 100 GRAMS OF PROPELLANT AT EQUILIBRIUM CONDITIONS

| | CHAM-BER | THROAT | EX-HAUST | | CHAM-BER | THROAT | EX-HAUST | | CHAM-BER | THROAT | EX-HAUST |
|---|---|---|---|---|---|---|---|---|---|---|---|
| $(XN)^2$ | 1.61E−11 | 0.00E+00 | 2.11E−21 | C | 7.00E−16 | 0.00E+00 | 1.00E−25 | C2 | 1.60E−23 | 0.00E+00 | 1.00E−25 |
| C2K | 1.62E−19 | 0.00E+00 | 1.00E−25 | C2H2 | 2.93E−18 | 0.00E+00 | 1.00E−25 | C2H6 | 7.24E−22 | 0.00E+00 | 1.00E−25 |
| C2H4O | 4.28E−24 | 0.00E+00 | 1.00E−25 | C2H6 | 1.00E−25 | 0.00E+00 | 1.00E−25 | C2N | 4.14E−20 | 0.00E+00 | 1.00E−25 |
| C2H2 | 1.17E−18 | 0.00E+00 | 1.00E−25 | C2O | 7.53E−16 | 0.00E+00 | 1.00E−25 | C3 | 1.00E−25 | 0.00E+00 | 1.00E−25 |
| C3O2 | 2.69E−18 | 0.00E+00 | 1.00E−25 | C4 | 1.00E−25 | 0.00E+00 | 1.00E−25 | C4H2 | 1.00E−25 | 0.00E+00 | 1.00E−25 |
| C5 | 1.00E−25 | 0.00E+00 | 1.00E−25 | C6H6 | 1.00E−25 | 0.00E+00 | 1.00E−25 | C8H8 | 1.00E−25 | 0.00E+00 | 1.00E−25 |
| C9H10 | 1.00E−25 | 0.00E+00 | 1.00E−25 | CH | 6.73E−16 | 0.00E+00 | 1.00E−25 | CH2 | 6.46E−15 | 0.00E+00 | 1.00E−25 |
| CH2O | 5.40E−09 | 0.00E+00 | 1.17E−17 | CH3 | 9.12E−14 | 0.00E+00 | 1.00E−25 | CH4 | 1.03E−13 | 0.00E+00 | 1.00E−25 |
| CH4O | 2.94E−14 | 0.00E+00 | 1.39E−25 | CH | 3.47E−12 | 0.00E+00 | 1.00E−25 | CH2 | 5.92E−18 | 0.00E+00 | 1.00E−25 |
| HCH | 9.58E−16 | 0.00E+00 | 1.00E−25 | CHO | 2.71E−10 | 0.00E+00 | 1.63E−21 | CO | 2.76E−02 | 0.00E+00 | 3.67E−06 |
| CO2 | 4.72E−01 | 0.00E+00 | 5.00E−01 | H | 7.11E−04 | 0.00E+00 | 8.26E−10 | H2 | 1.91E−02 | 0.00E+00 | 1.15E−03 |
| H2O | 1.97E+00 | 0.00E+00 | 2.00E+00 | N2O2 | 6.63E−06 | 0.00E+00 | 4.83E−11 | HCH | 1.32E−09 | 0.00E+00 | 4.28E−20 |
| HCO | 4.95E−08 | 0.00E+00 | 5.80E−18 | HNCO | 1.92E−08 | 0.00E+00 | 5.33E−16 | HNO | 2.09E−06 | 0.00E+00 | 7.38E−13 |
| HNO2 | 1.08E−06 | 0.00E+00 | 9.57E−12 | HNO3 | 3.34E−10 | 0.00E+00 | 1.37E+16 | HO2 | 2.77E−05 | 0.00E+00 | 3.96E−11 |
| H | 6.06E−08 | 0.00E+00 | 3.68E−18 | H2 | 1.49E+00 | 0.00E+00 | 1.50E+00 | H2H6 | 2.18E−15 | 0.00E+00 | 1.00E−25 |
| H2O | 2.39E−06 | 0.00E+00 | 5.84E−11 | H2O5 | 6.59E−13 | 0.00E+00 | 7.96E−23 | H2O4 | 6.60E−17 | 0.00E+00 | 1.00E−25 |
| H2O. | 5.08E−20 | 0.00E+00 | 1.00E−25 | H3 | 1.53E−11 | 0.00E+00 | 2.86E−22 | HH | 1.93E−08 | 0.00E+00 | 8.42E−19 |
| HH2 | 7.32E−08 | 0.00E+00 | 2.89E−16 | HH3 | 6.17E−07 | 0.00E+00 | 2.62E−12 | HO | 8.42E−03 | 0.00E+00 | 1.38E−06 |
| NO2 | 7.92E−06 | 0.00E+00 | 7.22E−11 | HO3 | 2.27E−11 | 0.00E+00 | 4.57E−20 | C | 3.60E−04 | 0.00E+00 | 7.47E−11 |
| O2 | 1.54E−02 | 0.00E+00 | 6.63E−06 | O3 | 2.11E−09 | 0.00E+00 | 9.80E−19 | OH | 1.49E−02 | 0.00E+00 | 1.04E−06 |
| C3 | 1.00E−25 | 0.00E+00 | 1.00E−25 | N2H4* | 1.00E−25 | 0.00E+00 | 1.00E−25 | H2O4* | 1.00E−25 | 0.00E+00 | 1.00E−25 |
| TOTAL MOLES: | 4.02553 | .00000 | 3.99778 | MOLES GAS: | 4.02553 | .00000 | 3.99778 | MOLES $": | .00000 | .00000 | .00000 |

As can be seen from the above Examples and corresponding testing, the high oxygen balance fuel of the present invention exhibits attractive propellant attributes and should be useful in a large number of pyrotechnic gas generant environments.

I claim:

1. A solid pyrotechnic gas generant composition comprising aminoquanidine dinitrate as a high oxygen balance fuel which is combustible to achieve a total gas output of 100.0 wt. %.

2. A pyrotechnic gas generant composition of claim 2, comprising 2–100% by weight of said high oxygen balance fuel.

3. A pyrotechnic gas generant composition of claim 2, comprising 50–100% by weight of said high oxygen balance fuel.

4. A pyrotechnic gas generant composition of claim 2, further comprising an oxidizer, said gas generant comprising from 0–50% by weight of oxidizer.

5. A pyrotechnic gas generant composition of claim 3, comprising from 0–60% by weight of said oxidizer.

6. A pyrotechnic gas generant composition of claim 4, further including at least one additive selected from the group consisting of a scavenger, ignition aid, ignition initiator, gas conversion catalyst, ballistic modifier, slag formers, binders, energetic binders, plasticizers, energetic plasticizers, fuels, stabilizers, curing agents, cure catalysts, cross linkers, coolants, and compounding aids and mixtures thereof.

7. A pyrotechnic gas generant composition of claim 6, wherein said oxidizer is selected from the group consisting of non-metallic, alkali metal, alkaline earth metal, transition metal and transition metal complex nitrates, nitrites, chlorates, chlorites, perchlorates, chromates, or mixtures thereof.

8. A pyrotechnic gas generant composition of claim 7, wherein said oxidizer comprises sodium nitrate and ammonium perchlorate.

9. A pyrotechnic gas generant composition of claim 7, said oxidizer comprising ammonium nitrate.

10. A pyrotechnic gas generant composition of claim 7, wherein said oxidizer comprises ammonium perchlorate, said composition further comprising an additive selected from at least one of the group consisting of ammonium perchlorate, phase stabilized ammonium nitrate, potassium perchlorate, strontium nitrate, potassium nitrate, lithium nitrate, and lithium carbonate and mixtures thereof.

11. A method for inflating an article capable of retaining gas, comprising the steps of:

(a) reacting a solid gas generant composition comprising aminoguanidine dinitrate as a high oxygen balance fuel which is combustible to achieve a total gas output of 100.0 wt. %;

(b) generating gas as a reaction product of said reaction of said high oxygen balance fuel; and (c) passing the gas into the article, thereby inflating the article.

12. The method of claim 11, wherein step (a) is practiced by reacting said high oxygen balance fuel as a monopropellant in the absence of oxidizers.

13. The method of claim 11, wherein step (a) is practiced by reacting said high oxygen balance fuel in the presence of an oxidizer.

14. The method of claim 13, wherein the reaction product of said high oxygen balance fuel and oxidizer generates gas and a solid material as reaction products.

15. The method of claim 14, further comprising passing said generated gas and solid material through a filter to thereby retain a portion of the solid material thereon, and then subsequently passing the filter gas on to the article.

16. A solid pyrotechnic gas generant composition comprising 100 wt. % of a high oxygen balance fuel as a monopropellant in the absence of an oxidizer, said high oxygen balance fuel being selected from the group consisting of aminoguanidine dinitrate, diaminoguanidine dinitrate, triaminoguanidine dinitrate, and mixtures thereof.

* * * * *

UNITED STATES PATENT AND TRADEMARK OFFICE

CERTIFICATE OF CORRECTION

PATENT NO. : 6,045,638
DATED : April 4, 2000
INVENTOR(S) : Norman H. LUNDSTROM

It is certified that error appears in the above-identified patent and that said letters patent is hereby corrected as shown below:

Figure 3, delete "1117.46ºC" and insert --117.46ºC--.

Signed and Sealed this

Third Day of April, 2001

*Attest:*

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,045,638
APPLICATION NO. : 09/168568
DATED : April 4, 2000
INVENTOR(S) : Norman H. Lundstrom It is certified that error appears in the above-identified patent and that said Letters Patent is hereby corrected as shown below:

Column 12, Line 25 Table 2, cancel Table 2 and replace the attached in its place.

TABLE 2

| INGREDIENT | ATOMIC COMPOSITION OF INGREDIENTS, GM-ATOMS/GFU H | C | N | O | MASS GRAMS | HT FORM KCAL/GFW | DENSITY GM/CM3 |
|---|---|---|---|---|---|---|---|
| AGDN | 8.000 | 1.000 | 6.000 | 6.000 | 100.000 | -144.000 | 1.7580 |

GRAM ATOM AMOUNTS FOR PROPELLANT MASS OF 100.000 GRAMS (H ) (C ) (N ) (O )
3.997771 .499721 2.998328 2.998328

PROPELLANT ENTHALPY = -71959.9 CAL/100GM; PROPELLANT DENSITY = 1.758 G/CC = .06352 LBM/IN3

| | ISP LBF*S/LBM | IVAC LBF*S/LBM | PRESSURE PSIA | TEMP. DEG K | ENTHALPY CAL/100GM | ENTROPY CAL/K*100GM | HT. CAP CAL/K*100GM | MOLS GAS MOLES/100GM | VELOC FT/SEC | AE/M FT2*SEC/LBM | C* FT/SEC | IVOL LBF*S/IN3 |
|---|---|---|---|---|---|---|---|---|---|---|---|---|
| CHAMBER | | | 1000.0000 | 2462.6 | -71960. | 239.005 | 46.160 | 4.0255 | | | | |
| EQ. XHST | 227.9 | 245.7 | 14.7000 | 1175.1 | -131650. | 239.005 | 39.470 | 3.9978 | 7332.4 | .0084187 | | 14.475 |
| FRZ THRT | 97.0 | 176.9 | 561.7072 | 2226.6 | -82770. | 239.005 | 45.406 | 4.0255 | 3120.4 | .0009878 | 4576.5 | |
| FRZ XHST | 224.9 | 242.2 | 14.7000 | 1117.6 | -130068. | 239.010 | 38.998 | 4.0255 | 7234.6 | .0081718 | | |

MOLES PER 100 GRAMS OF PROPELLANT AT EQUILIBRIUM CONDITIONS

| | CHAMBER | THROAT | EXHAUST | | CHAMBER | THROAT | EXHAUST | | CHAMBER | THROAT | EXHAUST |
|---|---|---|---|---|---|---|---|---|---|---|---|
| (NH)2 | 1.61E-11 | 0.00E+00 | 2.11E-21 | | | | | | | | |
| C2H | 1.62E-19 | 0.00E+00 | 1.00E-25 | C | 7.00E-16 | 0.00E+00 | 1.00E-25 | C2 | 1.60E-23 | 0.00E+00 | 1.00E-25 |
| C2H40 | 4.28E-24 | 0.00E+00 | 1.00E-25 | C2H2 | 2.93E-18 | 0.00E+00 | 1.00E-25 | C2H4 | 7.24E-22 | 0.00E+00 | 1.00E-25 |
| C2N2 | 1.17E-18 | 0.00E+00 | 1.00E-25 | C2H6 | 1.00E-25 | 0.00E+00 | 1.00E-25 | C2N | 4.14E-20 | 0.00E+00 | 1.00E-25 |
| C3O2 | 2.69E-18 | 0.00E+00 | 1.00E-25 | C2O | 7.83E-16 | 0.00E+00 | 1.00E-25 | C3 | 1.00E-25 | 0.00E+00 | 1.00E-25 |
| C5 | 1.00E-25 | 0.00E+00 | 1.00E-25 | C4 | 1.00E-25 | 0.00E+00 | 1.00E-25 | C4N2 | 1.00E-25 | 0.00E+00 | 1.00E-25 |
| C9H10 | 1.00E-25 | 0.00E+00 | 1.00E-25 | C6H6 | 1.00E-25 | 0.00E+00 | 1.00E-25 | C8H8 | 1.00E-25 | 0.00E+00 | 1.00E-25 |
| CH2O | 5.40E-09 | 0.00E+00 | 1.17E-17 | CH | 6.37E-16 | 0.00E+00 | 1.00E-25 | CH2 | 6.46E-15 | 0.00E+00 | 1.00E-25 |
| CH4O | 2.94E-14 | 0.00E+00 | 1.39E-25 | CH3 | 9.12E-14 | 0.00E+00 | 1.00E-25 | CH4 | 1.03E-13 | 0.00E+00 | 1.19E-25 |
| HCN | 9.88E-16 | 0.00E+00 | 1.00E-25 | CN | 3.47E-12 | 0.00E+00 | 1.00E-25 | CN2 | 5.92E-18 | 0.00E+00 | 1.00E-25 |
| CO2 | 4.72E-01 | 0.00E+00 | 5.00E-01 | CNO | 2.71E-10 | 0.00E+00 | 1.63E-21 | CO | 2.76E-02 | 0.00E+00 | 3.67E-06 |
| N2O | 1.97E+00 | 0.00E+00 | 2.00E+00 | H | 7.11E-04 | 0.00E+00 | 8.26E-10 | H2 | 1.91E-02 | 0.00E+00 | 1.15E-05 |
| HCO | 4.95E-08 | 0.00E+00 | 5.80E-18 | N2O2 | 6.63E-06 | 0.00E+00 | 4.83E-11 | HCN | 1.32E-09 | 0.00E+00 | 4.28E-20 |
| HNO2 | 1.08E-06 | 0.00E+00 | 9.57E-12 | HNCO | 1.92E-08 | 0.00E+00 | 5.35E-16 | HNO | 2.09E-06 | 0.00E+00 | 7.38E-13 |
| N | 6.06E-08 | 0.00E+00 | 3.68E-18 | HNO3 | 3.34E-10 | 0.00E+00 | 1.37E-16 | HO2 | 2.77E-05 | 0.00E+00 | 3.96E-11 |
| N2O | 2.39E-06 | 0.00E+00 | 5.84E-11 | N2 | 1.49E+00 | 0.00E+00 | 1.50E+00 | N2H4 | 2.18E-15 | 0.00E+00 | 1.00E-25 |
| N2O5 | 5.08E-20 | 0.00E+00 | 1.00E-25 | N2O3 | 6.59E-13 | 0.00E+00 | 7.96E-23 | N2O4 | 6.60E-17 | 0.00E+00 | 1.00E-25 |
| NH2 | 7.52E-08 | 0.00E+00 | 2.89E-16 | N3 | 1.53E-11 | 0.00E+00 | 2.86E-22 | NH | 1.93E-08 | 0.00E+00 | 8.42E-19 |
| NO2 | 7.92E-06 | 0.00E+00 | 7.22E-11 | NH3 | 6.17E-07 | 0.00E+00 | 2.62E-12 | NO | 8.42E-03 | 0.00E+00 | 1.38E-06 |
| O2 | 1.54E-02 | 0.00E+00 | 6.63E-06 | NO3 | 2.27E-11 | 0.00E+00 | 4.57E-20 | O | 3.60E-04 | 0.00E+00 | 7.47E-11 |
| CS | 1.00E-25 | 0.00E+00 | 1.00E-25 | O3 | 2.11E-09 | 0.00E+00 | 9.80E-19 | OH | 1.49E-02 | 0.00E+00 | 1.04E-06 |
| | | | | N2H4* | 1.00E-25 | 0.00E+00 | 1.00E-25 | N2O4* | 1.00E-25 | 0.00E+00 | 1.00E-25 |
| TOTAL MOLES: | 4.02553 | .00000 | 3.99778 | MOLES GAS: | 4.02553 | .00000 | 3.99778 | MOLES S,*: | .00000 | .00000 | .00000 |

Signed and Sealed this

Eighteenth Day of March, 2008

JON W. DUDAS
*Director of the United States Patent and Trademark Office*